US008727121B2

(12) United States Patent
Parikh et al.

(10) Patent No.: US 8,727,121 B2
(45) Date of Patent: May 20, 2014

(54) TRAY FOR A FOOD PRODUCT

(75) Inventors: Samir R. Parikh, Brampton (CA); Sajith Chenat, Brampton (CA)

(73) Assignee: Par-Pak Ltd., Brampton (CA)

( * ) Notice: Subject to any disclaimer, the term of this patent is extended or adjusted under 35 U.S.C. 154(b) by 0 days.

(21) Appl. No.: 13/364,842

(22) Filed: Feb. 2, 2012

(65) Prior Publication Data

US 2013/0199959 A1 Aug. 8, 2013

(51) Int. Cl.

| | |
|---|---|
| ***B65D 21/02*** | (2006.01) |
| ***B65D 21/032*** | (2006.01) |
| ***B65D 21/04*** | (2006.01) |
| ***B65D 85/34*** | (2006.01) |
| ***B65D 1/34*** | (2006.01) |

(52) U.S. Cl.

USPC ..... 206/519; 206/503; 206/505; 206/507; 206/509; 206/511; 206/515; 206/516; 206/518; 206/557

(58) Field of Classification Search

USPC ..... 206/503–505, 507, 509, 511, 515–516, 206/518–519, 557

See application file for complete search history.

(56) References Cited

U.S. PATENT DOCUMENTS

| | | | | |
|---|---|---|---|---|
| 2,378,627 | A * | 6/1945 | Grant | 217/26.5 |
| 3,000,528 | A * | 9/1961 | Kuhl et al. | 217/26.5 |
| 3,853,221 | A * | 12/1974 | Boyd | 206/523 |
| 3,989,154 | A * | 11/1976 | Walklet | 217/26.5 |
| 4,101,049 | A * | 7/1978 | Wallace et al. | 206/521.1 |
| 4,896,774 | A * | 1/1990 | Hammett et al. | 206/516 |
| 5,597,073 | A * | 1/1997 | Kocis | 206/564 |
| 6,869,059 | B2 | 3/2005 | Sloan et al. | |
| 6,905,017 | B1 | 6/2005 | Sarnoff et al. | |
| 2005/0238773 | A1 | 10/2005 | Stease | |
| 2007/0175790 | A1 | 8/2007 | Fernandez et al. | |
| 2011/0132796 | A1 | 6/2011 | Epstein | |

FOREIGN PATENT DOCUMENTS

| | | |
|---|---|---|
| EP | 2286667 | 2/2011 |
| WO | 2006057662 | 6/2006 |
| WO | 2009089583 | 7/2009 |

* cited by examiner

*Primary Examiner* — Fenn Mathew
*Assistant Examiner* — Jennifer Castriotta
(74) *Attorney, Agent, or Firm* — Bereskin & Parr LLP/S.E.N.C..R.L., s.r.l.

(57) ABSTRACT

A tray for a food product is thin-walled, unitary, and plastic. The tray comprises a central portion. The central portion comprises a plurality of downwardly extending recesses for receiving at least one of the food products, and a plurality of upwardly extending posts interspersed amongst the recesses. A first set of the posts is positioned on a first side of a horizontal axis of the tray, and a second set of the posts is positioned on a second side of the horizontal axis. The first set of posts and the second set of posts are positioned asymmetrically on either side of the horizontal axis. Each post comprises a plurality of reinforcing ribs extending lengthwise therealong. The reinforcing ribs are integral to the posts. The tray further comprises an outer wall portion extending about the central portion. A plurality of webs extend between the outer wall portion and the central portion.

20 Claims, 7 Drawing Sheets

TRAY FOR A FOOD PRODUCT

FIELD

The disclosure relates to trays for storing and/or transporting food products, such as muffins.

BACKGROUND

U.S. patent application publication No. US20110132796A1 (Epstein) purports to disclose a multi-compartment food tray that includes at least a first compartment and a second compartment formed from a paperboard material. Each compartment includes a compartment lip, and a carrier constructed from a paperboard material and including openings receiving the first and second compartments. Each compartment lip may be mechanically coupled to the carrier to create an interface. The interface may remain coupled during food reconstitution, and may include at least one surface having a coating. The first compartment may have a different volume than the second compartment.

SUMMARY

The following summary is intended to introduce the reader to various aspects of the applicant's teaching, but not to define any invention.

According to one broad aspect, a tray for a plurality food products is disclosed. The tray is thin-walled, unitary, and plastic. The tray comprises a central portion. The central portion comprises a plurality of downwardly extending recesses for receiving at least one of the food products, and a plurality of upwardly extending posts interspersed amongst the recesses. A first set of the posts is positioned on a first side of a horizontal axis of the tray, and a second set of the posts is positioned on a second side of the horizontal axis. The first set of posts and the second set of posts are positioned asymmetrically on either side of the horizontal axis. Each post comprises a plurality of reinforcing ribs extending lengthwise therealong. The reinforcing ribs are integral to the posts. The tray further comprises an outer wall portion extending about the central portion. A plurality of webs extend between the outer wall portion and the central portion.

The posts may align with and nest within posts of another tray when the tray is in a first orientation, to allow nesting of the tray with the other tray. The posts may mis-align with the posts of the other tray with the tray is in a second orientation, to prevent nesting of the tray with the other tray and allow stacking of the tray with the other tray. To move the tray between the first orientation and the second orientation, the tray may be rotated about a vertical axis. The tray may be rotated about the vertical axis by an angle of about 180 degrees.

The tray may further comprise a plurality of abutment members interspersed amongst the posts and recesses. The tray may comprise a first set of abutment members. The first set of abutment members and the second set of posts may be positioned symmetrically on either side of the horizontal axis. The tray may further comprise a second set of abutment members. The first set of abutment members and the first set of posts may be positioned symmetrically on either side of the horizontal axis.

The abutment members may comprise a downwardly extending depression having a bottom abutment surface. The bottom abutment surfaces may each comprise a locating dimple for receiving one of the posts of another tray. When the tray is in the second orientation, the first set of posts may abut the second set of abutment members of the other tray, and the second set of posts may abut the first set of abutment members of the other tray.

The webs may extend between the outer wall portion and the abutment members.

The first set of posts may include a first number of posts, and the second set of posts may include a second number of posts. The first number may be different from the second number.

The tray may comprise five webs extending between the outer wall portion and the central portion.

The reinforcing ribs may extend from a bottom portion of the posts to a top portion of the posts.

The drawings included herewith are for illustrating various examples of articles, methods, and apparatuses of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Figure 1:
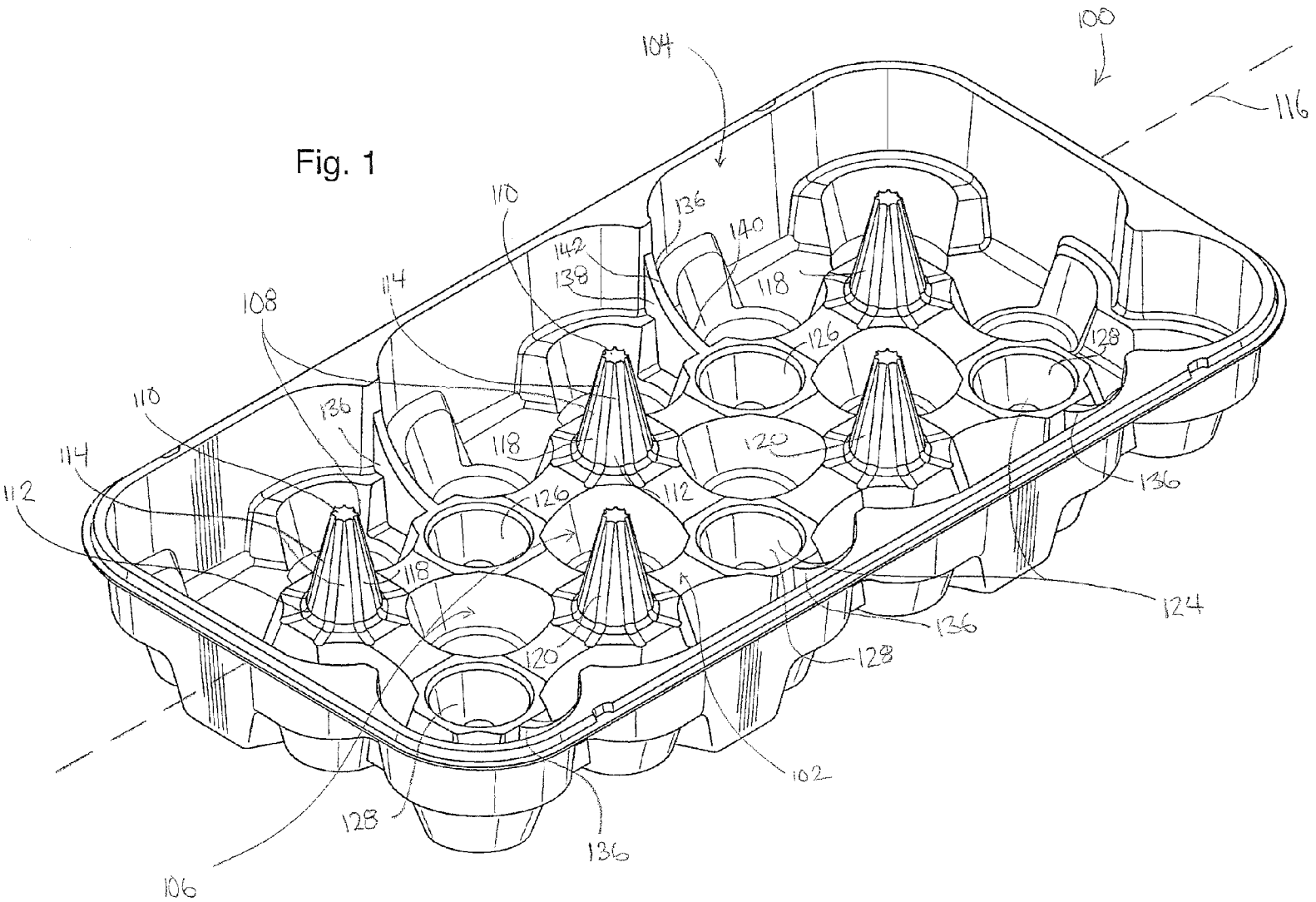
FIG. 1 is a perspective illustration of a tray.
Figure 2:
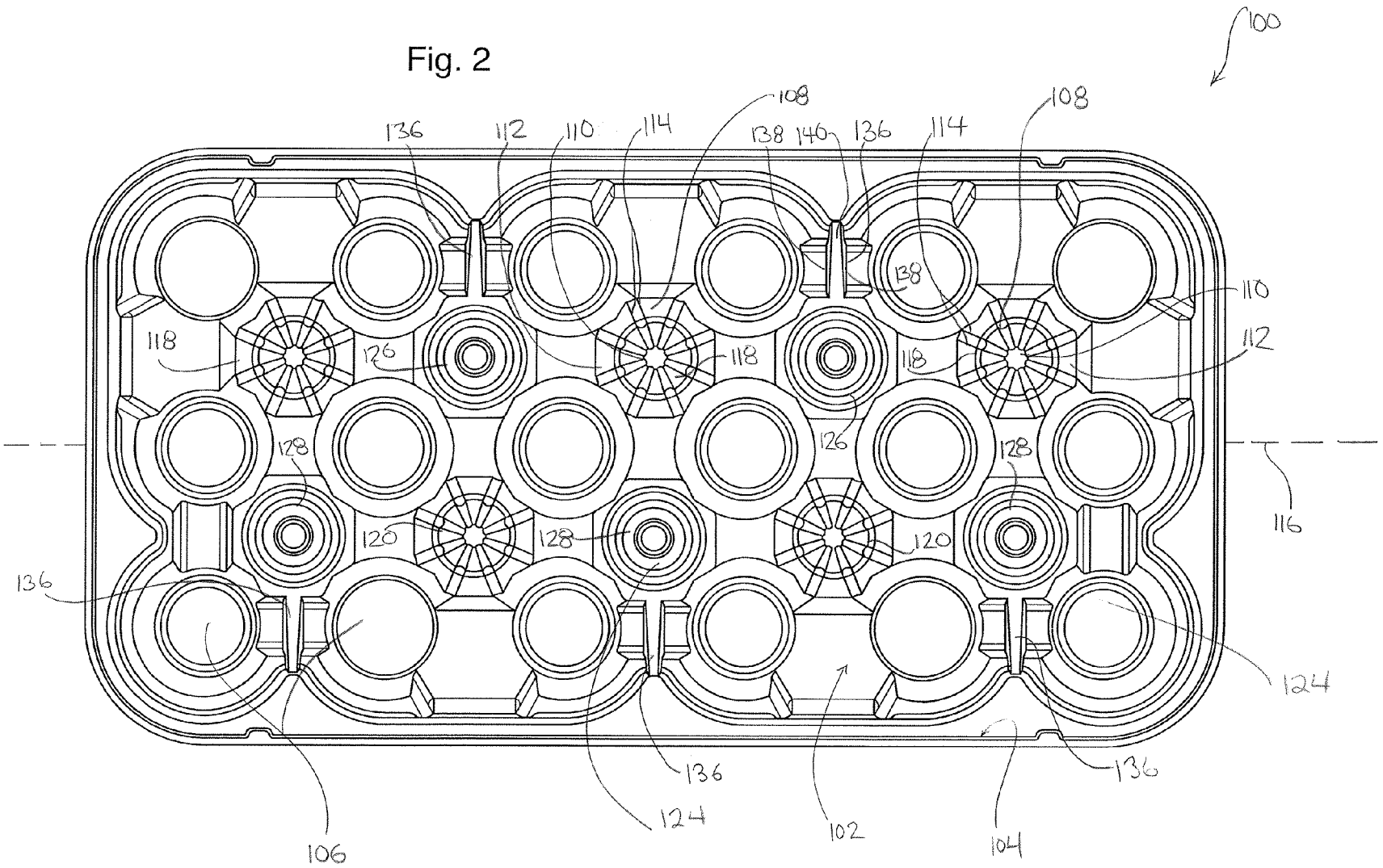
FIG. 2 is a top plan view of the tray of FIG. 1.
Figure 3:
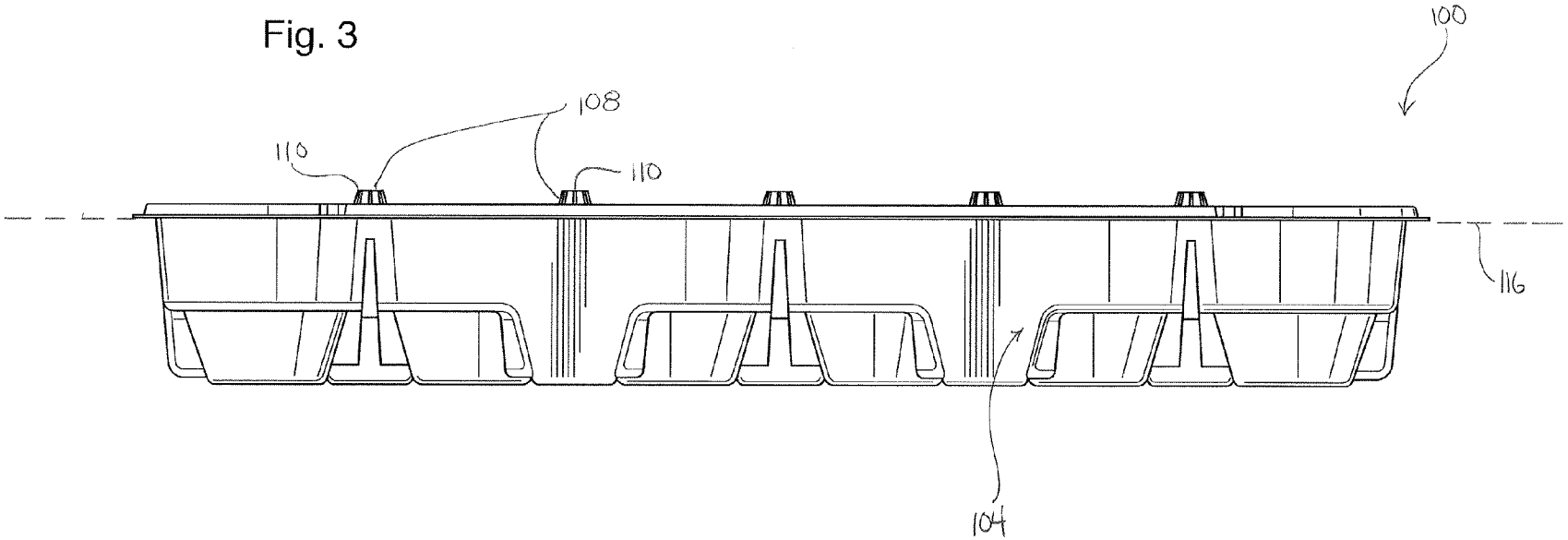
FIG. 3 is a side plan view of the tray of FIG. 1.

Referring to FIGS. 1 to 3, an exemplary tray 100 is shown. The tray 100 may be used to store and/or transport a food product. In the example shown, the tray 100 is configured to store and/or transport a muffin, or similarly shaped food product. In alternate examples, a tray may be configured to store and/or transport another type of food product.

In the example shown, the tray 100 is fabricated from a plastic, such as polyethylene terephthalate (PETE), and is thin-walled and unitary. For example, the tray 100 may be thermoformed from a sheet of plastic. In alternate examples, a tray may be formed from another material.

Referring still to FIGS. 1 to 3, the tray 100 includes a central portion 102, which receives the food products, and an outer wall portion 104 extending about the central portion 102.

Referring still to FIGS. 1 to 3, the central portion 102 includes a plurality of downwardly extending recesses 106. Each recess 106 may receive at least one of the food products. In the example shown, the central portion 102 includes eighteen recesses 106 that are arranged in a three by six grid, and each recess 106 is configured to receive one muffin. Specifically, each recess is generally inverted frustoconical in shape. In alternate examples, a central portion may include an alternate number of recesses, such as twelve recesses, and the recesses may be arranged in an alternate fashion, such as a three by four grid. Further, the recesses may be of an alternate shape, such as cylindrical or cubic.

Referring still to FIGS. 1 and 2, the central portion 102 further includes a plurality of upwardly extending posts 108 interspersed amongst the recesses 106 (only two of the posts are labeled in the Figures). The posts 108 serve to provide structural rigidity to the central portion 102, and also allow the tray 100 to selectively stack or nest with other trays, as will be explained further below with reference to FIGS. 4 to 7.

Referring still to Figures and 2, in the example shown, the posts 108 are generally frustoconical, and have a top portion 110, a bottom portion 112, and a length extending therebetween. The posts 108 extend generally vertically upwardly. In alternate examples, posts may be another shape, such as cylindrical, or cubic.

Referring still to FIGS. 1 to 3, the posts 108 further include a plurality of reinforcing ribs 114, which are integral to the posts 108. The reinforcing ribs 114 extend generally lengthwise along the posts 108.

In the example shown, each post includes eight reinforcing ribs 114, which extend in a generally linear fashion from the top portion 110 to the bottom portion 112 of each post 108.

As mentioned above, the posts 108 allow the tray 100 to selectively stack or nest with other trays. Referring still to FIGS. 1 to 3, the tray 100 extends along a horizontal axis 116. A first set 118 of the posts 108 is positioned on a first side of the horizontal axis 116, and a second set 120 of the posts 108 is positioned on a second side of the horizontal axis 116. The first set 118 of posts 108 and the second set 120 of posts 108 are positioned asymmetrically on either side of the horizontal axis 116. That is, the first set 118 of posts 108 and the second set 120 of posts 108 are not positioned in a mirror image fashion on either side of the horizontal axis 116. In the example illustrated, the first set 118 has three posts 108, and the second set 120 has two posts 108.

Figure 4:
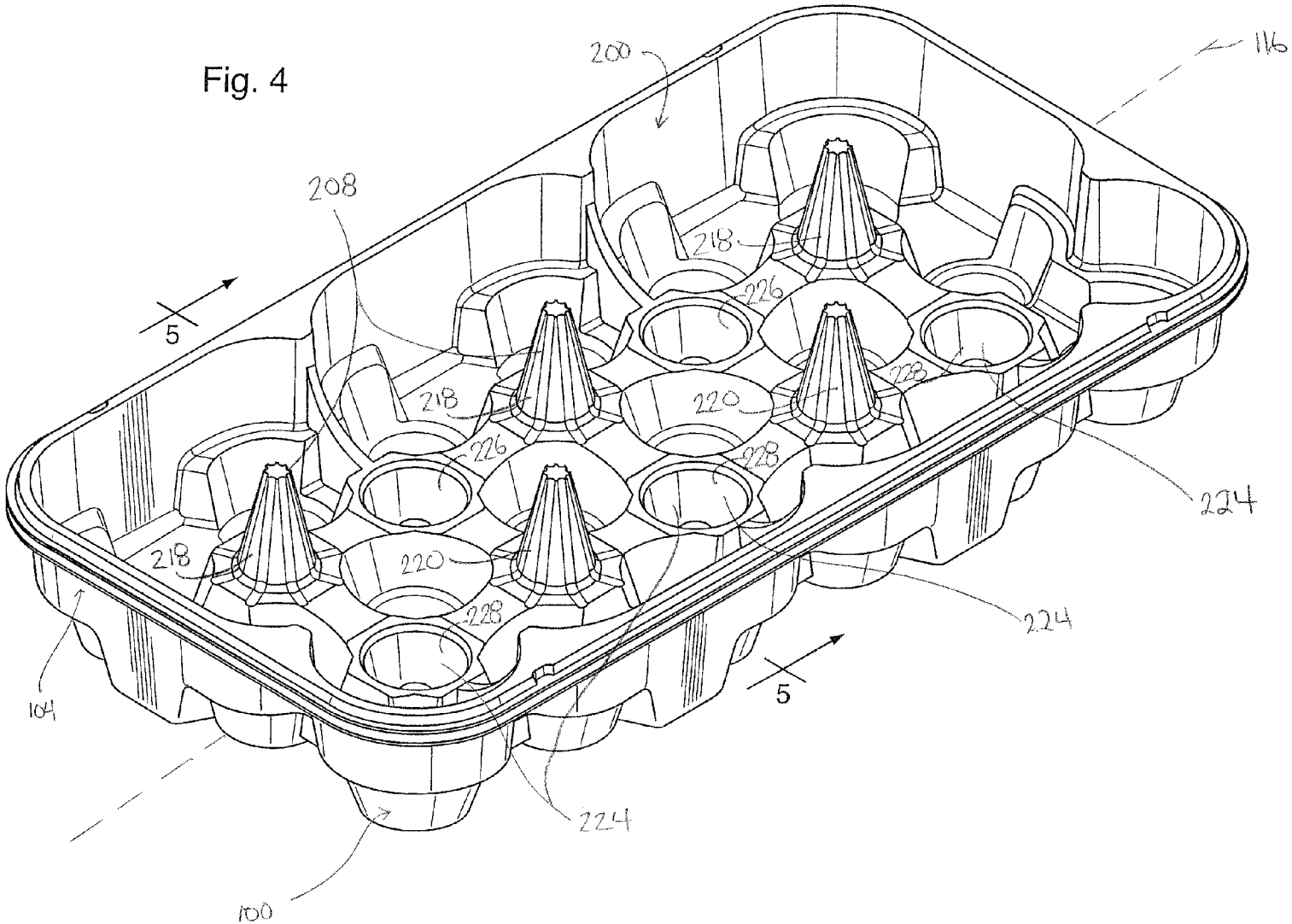
FIG. 4 is a perspective illustration of the tray of FIG. 1, nested within another tray.
Figure 5:
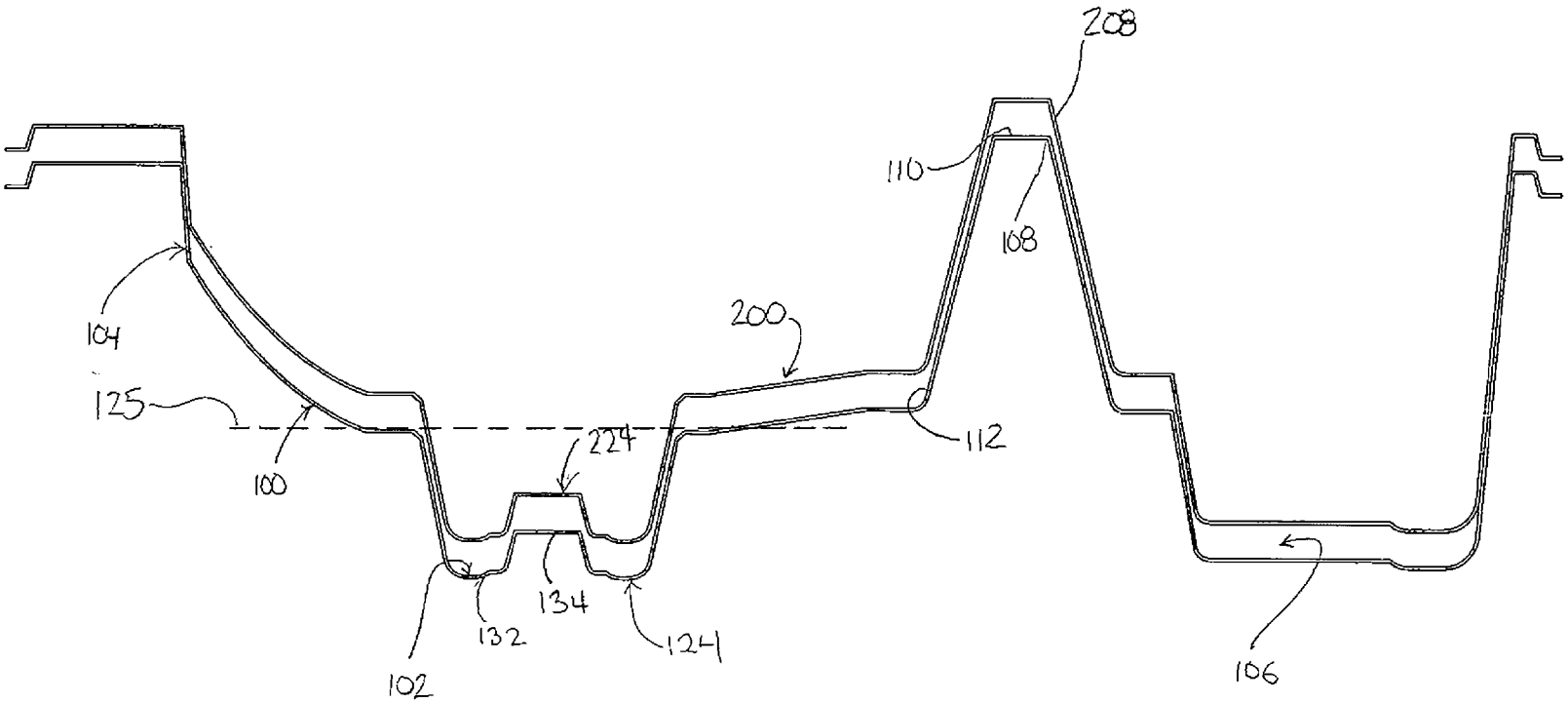
FIG. 5 is a cross-section taken along line 5-5 in FIG. 4.

Referring now to FIGS. 4 and 5, the tray 100 is shown in a first orientation with respect to another second, upper tray 200. The second tray 200 is essentially identical to the tray 100, and like features in tray 200 are identified by like reference characters, incremented by 100. In this orientation, the posts 108 of the tray 100 align with and nest within the hollow interiors of the posts 208 of the other tray 200. Specifically, the first set 118 of posts 108 of the tray 100 aligns with and nests within the first set 218 of posts 208 of the other tray 200, and the second set 120 of posts 108 of the tray 100 aligns with and nests within the second set 220 of posts 208 of the other tray 200, to allow nesting of the tray 100 with the other tray 200 in a vertically compact or compressed manner. Such nesting may be useful, for example, in storing and/or transporting empty trays.

Figure 6:
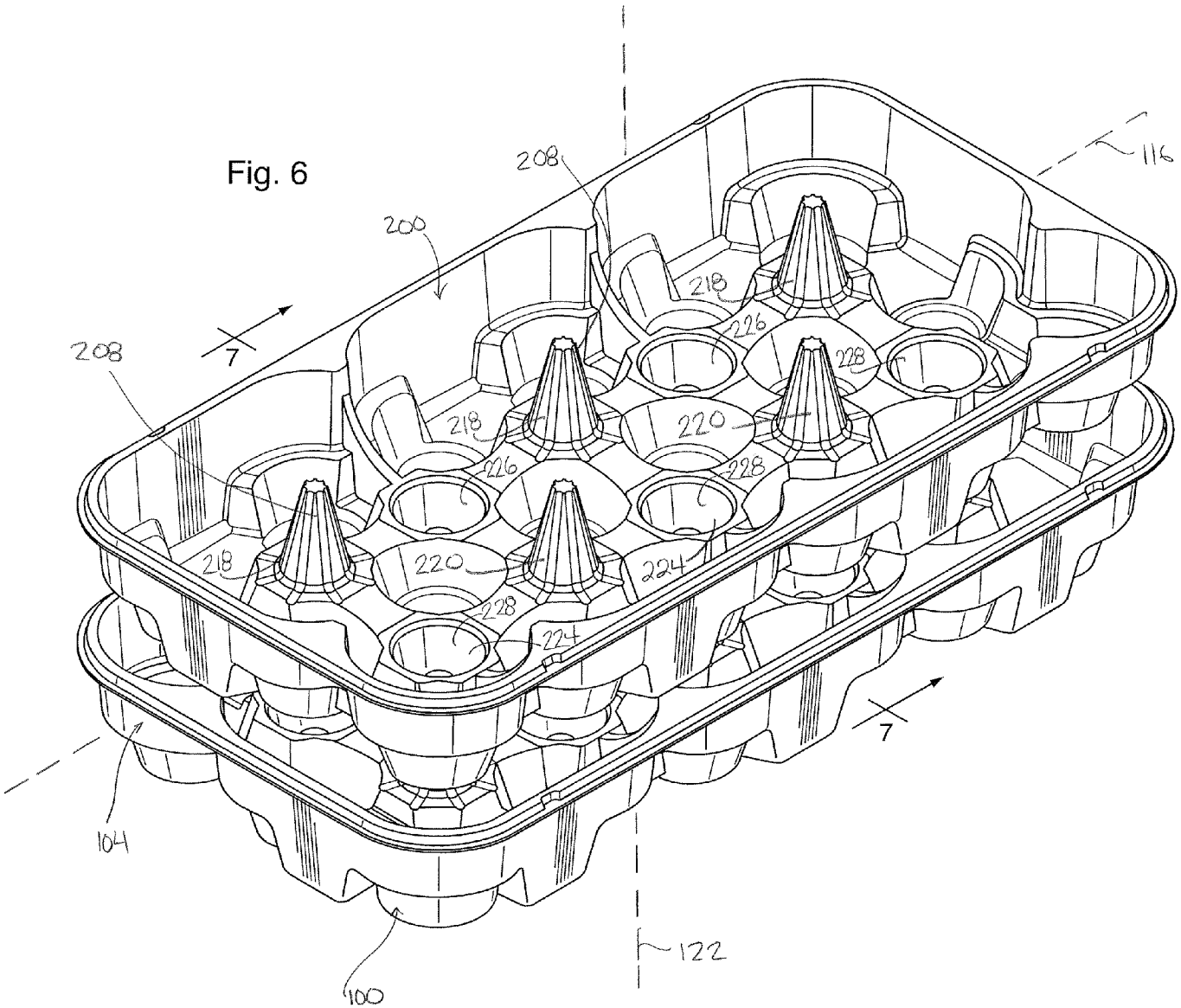
FIG. 6 is a perspective illustration of the tray of FIG. 1, with another tray stacked thereon.
Figure 7:
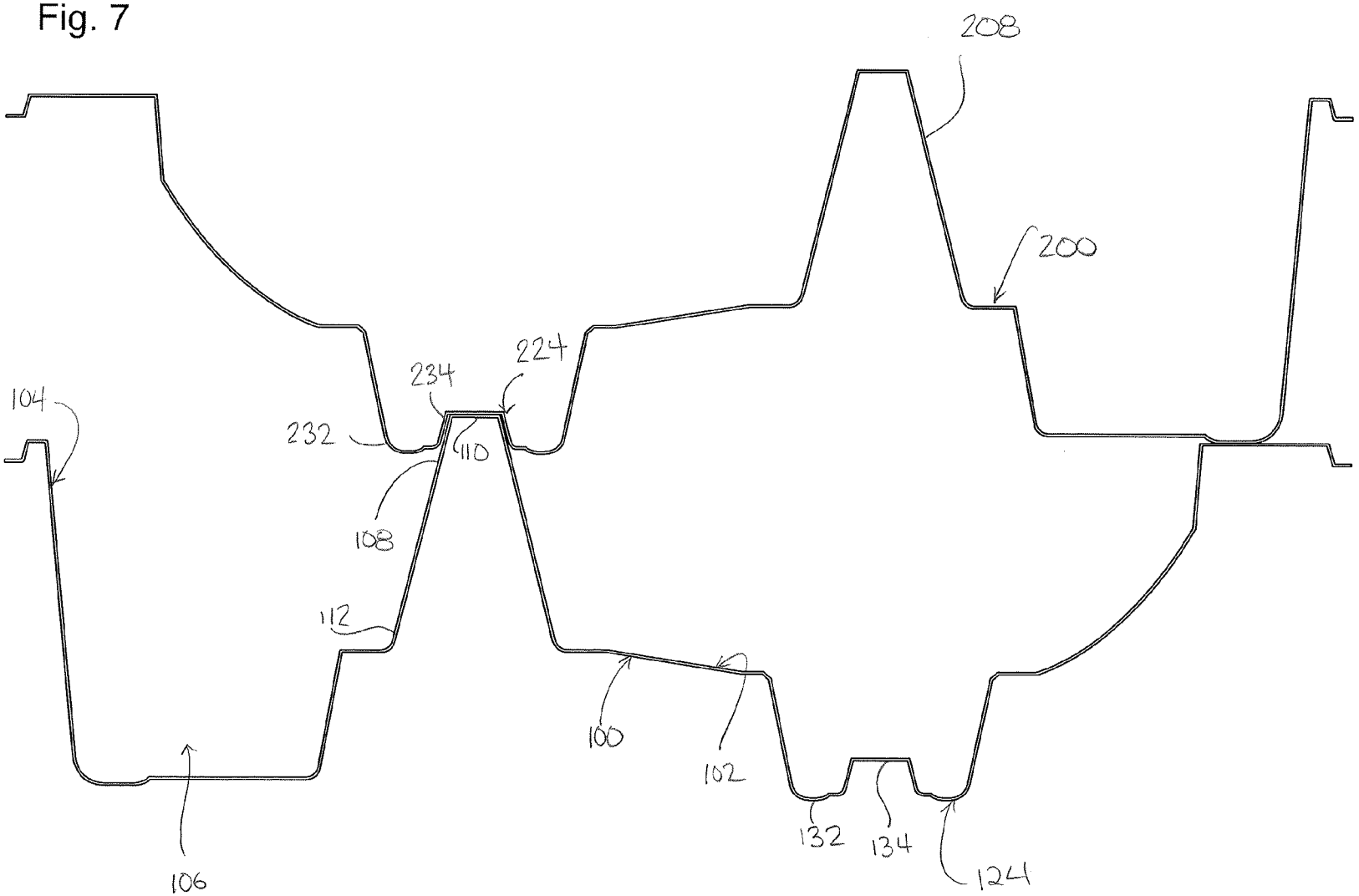
FIG. 7 is a cross-section taken along line 7-7 in FIG. 6.

Referring now to FIGS. 6 and 7, the tray 100 is shown in a second orientation with respect to the second tray 200. In this orientation, the tray 100 has been rotated by 180 degrees about a vertical axis 122 with respect to the other tray 200, so that the horizontal axis 116 of the tray 100 has been rotated by 180 degrees. In this orientation, the posts 108 of the tray 100 mis-align with the posts 208 of the other tray 200. Specifically, the first set 118 of posts 108 of the tray 100 aligns with neither the first set 218 of posts 208 nor the second set 220 of posts 108 of the other tray 200, and the second set 120 of posts 108 of the tray 100 aligns with neither the second set 220 of posts 208 nor the first set 218 of posts 208 of the other tray 200. In this orientation, nesting of the tray 100 with the other tray 200 is prevented, and stacking of the tray 100 with the other tray 200 is allowed in a vertically expanded manner. Such stacking may be useful, for example, in storing and/or transporting full trays. The bottom surface of the upper tray 200 can remain spaced apart from muffins in the lower tray 100 (FIG. 7), when the trays are stacked.

In the example shown, the first set 118 of posts 108 includes a first number of posts, and the second set 120 of posts 108 includes a second number of posts that is different from the first number. Specifically, the first set 118 of posts 108 includes three posts 108, and the second set 120 of posts 108 includes two posts 108. The posts 108 of the first set 118 are arranged generally in a first row, and are generally evenly spaced apart along the length of the tray 100. The posts 108 of the second set 120 are spaced apart along the length of the tray 100 and aligned along a second row, and as mentioned above, are not positioned in a mirror image fashion with any of the posts 108 of the first set 118.

In alternate examples, posts may be positioned in another manner. For example, the first number of posts and the second number of posts may be equal.

Referring back to FIGS. 1 to 3, in the example shown, the tray 100 further includes a plurality of abutment members 124 interspersed amongst the posts 108 and recesses 106 (only two of the abutment members are labeled in the Figures). Specifically, the tray includes a first set 126 of abutment members 124 interspersed amongst the first set 118 of posts 108, and a second set 128 of abutment members 124 interspersed amongst the second set 120 of posts 108. The first set 126 of abutment members 124 and the second set 128 of posts 108 are positioned symmetrically on either side of the horizontal axis 116. The second set 128 of abutment members 124 and the first set 118 of posts 108 are positioned symmetrically on either side of the horizontal axis 116. That is, the first set 126 of abutment members 124 and the second set 128 of posts 108 are positioned in a mirror image fashion on either side of the horizontal axis 116, and the second set 128 of abutment members 124 and the first set 118 of posts 108 are positioned in a mirror image fashion on either side of the horizontal axis 116.

In the example shown, the abutment members 124 are downwardly extending depressions, which have a bottom abutment surface 132 (shown in FIGS. 5 and 7). The bottom abutment surface includes a locating dimple 134 (shown in FIGS. 5 and 7. Referring to FIG. 5, in the illustrated example the posts 108 extend entirely upwardly from an upper side of a horizontal plane 125 that extends through the central portion 102 of the tray 100, and the abutment members 124 extend entirely downwardly from a lower side of the horizontal plane 125. In this example, the bottom portion 112 of each post 108 is proximate the plane 125 and the top portion 110 is spaced vertically above the plane 125.

Referring back to FIGS. 6 and 7, when the tray 100 is in the second orientation, the posts 108 abut the abutment members 224 of the other tray 200, to support the other tray 200 and prevent lateral sliding of the other tray 200. Specifically, the first set 118 of posts 108 abuts the second set 228 of abutment members 224 of the other tray 200, and the second set 120 of posts 108 abuts the first set 226 of abutment members 224 of the other tray 200. Further, the top portions 110 of the posts 108 are received in the locating dimples 234 of the other tray 200, to prevent lateral shifting of the trays when the trays are stacked.

Referring back to FIGS. 1 to 3, the tray further includes a plurality of webs 136 extending between the outer wall portion 104 and the central portion 102. The webs 136 may provide structural support to the tray 100. In the example shown, the tray 100 includes five webs 136, and the webs 136 each extend between an inner surface of the outer wall portion 104 and one of the abutment members 124.

In alternate examples, a tray may include another number of webs. Further, the webs may be positioned in another manner. For example, the webs may extend between the outer wall portion and the posts.

Referring to FIGS. 1 and 2, in the example shown, the webs 136 include a pair of opposed side walls 138, 140, and a top wall 142 (labeled only on one of the webs). The top wall 142 is sloped generally downwardly.

In alternate examples, webs may be of another shape and/or configuration. For example, the webs may include only a single generally vertically extending wall.

While the above description provides examples of one or more processes or apparatuses, it will be appreciated that other processes or apparatuses may be within the scope of the accompanying claims.

The invention claimed is:

1. A thin-walled unitary plastic tray for holding a plurality of food items, the tray comprising:

a) a central portion comprising a plurality of recesses, a plurality of posts and a plurality of abutment members;

b) each recess of the plurality of recesses configured to receive at least one of a plurality of food items and the plurality of recesses includes a first set of recesses arranged in a first row extending in a first lateral direction and a second set of recesses arranged in a second row extending parallel to the first lateral direction and spaced apart from the first row in a second lateral direction that is generally orthogonal to the first lateral direction;

c) the plurality of posts being separate from and laterally spaced apart from the plurality of recesses and disposed laterally between the plurality of recesses, each post extending generally upwardly from a bottom end to an upper end spaced above the bottom end in a third direction that is generally orthogonal to both the first and second lateral directions, the plurality of posts comprising a first set of posts disposed on a first side of a lateral axis extending parallel to first lateral direction and a second set of posts disposed on a second side of the lateral axis laterally opposite the first side;

d) the plurality of abutment members being separate from and laterally spaced apart from the plurality of recesses, the abutment members interspersed laterally between the recesses and the posts, each abutment member comprising a downward facing abutment surface, the plurality of abutment members comprising a first set of abutment members disposed on the first side of the lateral axis and opposing the second set of posts and a second set of abutment members disposed on the second side of the lateral axis and being laterally offset from the first set of abutment members and opposing the first set of posts; and the first set of posts and the first set of abutment members disposed between the first row and second row in the second lateral direction and the plurality of posts and the plurality of abutment members arranged such that:

i) when the tray is in a first orientation relative to a like second tray the plurality of posts on the tray are aligned with and can nest within a second plurality of posts on the second tray to allow vertically collapsed nesting of the second tray onto the first tray; and ii) when the tray is in a different, second orientation relative to the second tray the upper ends of the plurality of posts each abut a respective one of a plurality of second downward facing abutment surfaces on the second tray to support the second tray above the plurality of recesses and allow vertically expanded stacking of the second tray above the first tray.

2. The tray of claim 1, wherein the plurality of recesses comprises at least a first recess and a second recess, and when the tray is in the first orientation one recess on the second tray overlies the first recess, and when the tray is in the second orientation the one recess on the second tray overlies the second recess.

3. The tray of claim 1, wherein the first set of posts and the first set of abutment members are arranged in an alternating pattern in the first direction.

4. The tray of claim 1, wherein to move between the first orientation and the second orientation, the tray is rotated about an axis extending parallel to the third direction by about 180 degrees.

5. The tray of claim 1, wherein when tray is in the second orientation relative to the second tray the second tray is spaced above the plurality of recesses in the third direction by a distance that is greater than a height of the plurality of food items in the third direction so that the second tray does not contact the plurality of food items.

6. The tray of claim 1, further comprising an outer wall portion extending generally upwardly about a peripheral edge of the central portion and a plurality of stiffening webs extending between an inner surface of the outer wall portion and the central portion.

7. The tray of claim 1, wherein each post comprises a plurality of integrally formed reinforcing ribs extending longitudinally therealong.

8. The tray of claim 1, wherein:

a) the first set of the abutment members and the second set of posts are positioned symmetrically on either side of the lateral axis; and b) the second set of the abutment members and the first set of posts are positioned symmetrically on either side of the lateral axis.

9. The tray of claim 8, wherein the abutment members comprise a downwardly extending depression having a bottom abutment surface.

10. The tray of claim 9, wherein the bottom abutment surfaces each comprise a locating dimple for receiving an upper portion of a respective one of the posts of the second tray when in the second orientation.

11. The tray of claim 8, wherein when the tray is in the second orientation, the first set of posts abuts the second set of abutment members of the other tray, and the second set of posts abuts the first set of abutment members of the other tray.

12. The tray of claim 1, wherein the first set of posts includes a first number of posts, and the second set of posts includes a second number of posts, and the first number is different from the second number.

13. A thin-walled unitary plastic tray for holding a plurality of food items, the tray comprising:

a) a central portion comprising a plurality of recesses, a plurality of posts and a plurality of abutment members;

b) each recess of the plurality of recesses configured to receive at least one of a plurality of food items and the plurality of recesses includes a first set of recesses arranged in a first row extending in a first direction and a second set of recesses arranged in a second row extending parallel to the first direction and spaced apart from the first row in a second direction that is generally orthogonal to the first direction;

c) the plurality of posts separate from and disposed horizontally between the plurality of recesses, each post disposed above a horizontal plane that is generally parallel to the first direction and the second direction, each post having a bottom end proximate the horizontal plane and an upper end spaced above the bottom end in a third direction that is orthogonal to the plane, the plurality of posts comprising a first set of posts disposed on a first side of an axis extending in the first direction and in the horizontal plane and a second set of posts disposed on a second side of the axis and being offset from the first set of posts in the first direction;

d) the plurality of abutment members being separate from and horizontally spaced apart from the plurality of recesses, the abutment members interspersed horizontally between the recesses and the posts, each abutment member disposed below the horizontal plane and comprising a downward facing abutment surface, the plurality of abutment members comprising a first set of abutment members disposed on the first side of the axis and opposing the second set of posts and a second set of abutment members disposed on the second side of the axis and being horizontally offset from the first set of abutment members and opposing the first set of posts;

the first set of posts and the first set of abutment members are disposed horizontally between the first row and second row in the second direction and the plurality of posts and the plurality of abutment members arranged such that:

i) when the tray is in a first orientation relative to a like second tray the plurality of posts on the tray are aligned with and can nest within a second plurality of posts on the second tray to allow vertically collapsed nesting of the second tray onto the first tray; and ii) when the tray is in a different, second orientation relative to the second tray the upper ends of the plurality of posts each abut a respective one of a plurality of second downward facing abutment surfaces on the second tray to support the second tray above the plurality of recesses and allow vertically expanded stacking of the second tray above the first tray.

14. The tray of claim 13, wherein the posts in the first set of posts and the abutment members in the first set of abutment members are arranged in an alternating pattern in the first direction.

15. The tray of claim 13, further comprising a central portion comprising the plurality of recesses, the plurality of posts and the plurality of abutment members and an outer wall portion extending generally upwardly about a peripheral edge of the central portion and a plurality of stiffening webs extending between an inner surface of the outer wall portion and the central portion.

16. The tray of claim 13, wherein each post comprises a plurality of integrally formed reinforcing ribs extending longitudinally therealong.

17. The tray of claim 13, wherein:

a) the abutment members in the first set of the abutment members and posts in the second set of posts are positioned symmetrically on either side of the axis; and b) the abutment members in the second set of the abutment members and the posts in the first set of posts are positioned symmetrically on either side of the axis.

18. The tray of claim 17, wherein the abutment members comprise a downwardly extending depression having a bottom abutment surface.

19. The tray of claim 18, wherein the bottom abutment surfaces each comprise a locating dimple for receiving an upper portion of a respective one of the posts of the second tray when in the second orientation.

20. The tray of claim 18, wherein when the tray is in the second orientation, the first set of posts abuts the second set of abutment members of the other tray, and the second set of posts abuts the first set of abutment members of the other tray.

* * * * *